US008147925B2

(12) United States Patent
Sugiura et al.

(10) Patent No.: US 8,147,925 B2
(45) Date of Patent: Apr. 3, 2012

(54) PATTERN FORMING METHOD

(75) Inventors: Yoshinori Sugiura, Nagoya (JP); Jun Nishikawa, Nagoya (JP); Ryoichi Nakaoka, Hirakata (JP); Chika Kanada, Hirakata (JP); Akito Harada, Hirakata (JP)

(73) Assignees: Inoac Corporation, Nagoya-Shi, Aichi (JP); Ju Teng International Holdings Ltd., Hong Kong (HK); Sang Broli Company Limited, Taiwan (CN)

( * ) Notice: Subject to any disclaimer, the term of this patent is extended or adjusted under 35 U.S.C. 154(b) by 1300 days.

(21) Appl. No.: 11/696,746

(22) Filed: Apr. 5, 2007

(65) Prior Publication Data

US 2007/0237891 A1 Oct. 11, 2007

(30) Foreign Application Priority Data

Apr. 5, 2006 (JP) ..... 2006-104267
Apr. 5, 2006 (JP) ..... 2006-104268

(51) Int. Cl.
*B05D 5/12* (2006.01)

(52) U.S. Cl. ..... 427/550; 427/547; 427/548; 427/549

(58) Field of Classification Search ..... 428/800–848.9; 252/62.54; 427/127, 128, 130, 598, 550, 427/547, 548, 549
See application file for complete search history.

(56) References Cited

U.S. PATENT DOCUMENTS 3,676,273 A 7/1972 Graves
3,791,864 A * 2/1974 Steingroever ..... 427/550
4,678,682 A * 7/1987 Asai et al. ..... 427/549
4,753,829 A 6/1988 Panush
5,192,611 A 3/1993 Tomiyama et al.
5,364,689 A * 11/1994 Kashiwagi et al. ..... 428/195.1

(Continued)

FOREIGN PATENT DOCUMENTS

CN 1500564 A 6/2004

(Continued)

OTHER PUBLICATIONS

Taiwan Patent Application No. 056110947, Office Action dated Aug. 15, 2011, English Translation, p. 5.

*Primary Examiner* — Michael Cleveland
*Assistant Examiner* — Tabassom Tadayyon Eslami
(74) *Attorney, Agent, or Firm* — Seager, Tufte & Wickhem LLC

(57) ABSTRACT

A pattern is formed by applying a coating composition containing magnetic particles to an article so that a coating film is formed, and a plurality of sheet form magnets are placed along the front surface of this coating film. Adjacent sheet form magnets are arranged in such a state that the magnetic poles on the front surface and the magnetic poles on the back surface are different between adjacent sheet form magnets, and side surfaces of the sheet form magnets contact each other. The coating composition contains a thermoplastic resin, magnetic particles with flaky form and a specific low boiling point solvent and a specific high boiling point solvent. A magnetic field is applied to the coating film by the sheet form magnets, so that the magnetic particles in the coating film are oriented by the magnetic field and the magnetic particles are oriented substantially parallel to the front surface of the coating film above the contact portions between the sheet form magnets. Light is reflected from the magnetic particles in the coating film so that a pattern is formed.

9 Claims, 5 Drawing Sheets

U.S. PATENT DOCUMENTS

| | | | | |
|---|---|---|---|---|
| 5,630,877 | A | 5/1997 | Kashiwagi et al. | |
| 6,261,647 | B1 * | 7/2001 | Komatsu et al. | 427/549 |
| 2003/0034869 | A1 * | 2/2003 | Matsumura et al. | 336/218 |
| 2004/0009309 | A1 * | 1/2004 | Raksha et al. | 427/598 |
| 2006/0194040 | A1 | 8/2006 | Raksha et al. | |

FOREIGN PATENT DOCUMENTS

| | | | |
|---|---|---|---|
| EP | 0 406 667 | A1 | 1/1991 |
| EP | 1205961 | A1 | 5/2002 |
| EP | 1493590 | A1 | 1/2005 |
| EP | 1541642 | A1 | 6/2005 |
| EP | 1 780 040 | A2 | 5/2007 |
| JP | 63-175670 | A | 7/1988 |
| JP | 63-183965 | A | 7/1988 |
| JP | 0406667 | * | 1/1991 |
| JP | 3-30876 | A | 2/1991 |
| JP | 4-225871 | A | 8/1992 |
| JP | 5-17709 | A | 1/1993 |
| JP | 5-86219 | A | 4/1993 |
| JP | 5-228428 | A | 9/1993 |
| JP | 5-329425 | A | 12/1993 |
| JP | 5-337424 | A | 12/1993 |
| JP | 6-88884 | A | 3/1994 |
| JP | 2000-271533 | A | 10/2000 |
| JP | 2003-176452 | A1 | 6/2003 |
| JP | 2007-21492 | A | 2/2007 |
| JP | 2007-275737 | A | 10/2007 |
| WO | 02090002 | A2 | 11/2002 |

* cited by examiner

PATTERN FORMING METHOD

BACKGROUND OF THE INVENTION

The present invention relates to a pattern forming apparatus and a pattern forming method where a magnetic field is applied to a coating composition which contains magnetic particles with flaky form during and after application of the coating composition to, for example, an article to be coated which is a nonmagnetic particle, and thus, the magnetic particles are oriented, so that a pattern is formed through orientation of the magnetic particles.

Conventional methods have been proposed for forming a pattern on a coating film where a coating composition containing magnetic particles is applied to the surface of an article to be coated and thereafter the magnetic particles are oriented by a magnetic field that is created by a magnet so that letters or figures emerge. Japanese Laid-Open Patent Publication No. 5-337424 discloses an apparatus for manufacturing a molded article having a coating film where a pattern is formed as described above. This manufacturing apparatus is provided with a supporting means for supporting the main body of a molded article, a coating film forming means for forming a coating film by applying a transparent or translucent coating composition in liquid form in which magnetic particles with flaky form are mixed on the surface of the main body of the molded article, magnetic field forming means for applying a magnetic field to the magnetic particles in the coating film and a magnetic field changing means for changing the magnetic field. In the magnetic field forming means, a first magnet and a neighboring second magnet are placed at a distance from each other so that a magnetic field (lines of magnetic force) is created so as to extend from the N pole of the first magnet to the S pole of the second magnet.

The magnetic particles which are mixed in with the coating composition easily settle and aggregate during storage, and furthermore, easily settle in the application machine at the time of application, and therefore, in some cases, distinctness in the border portions in the formed pattern and appearance of depth in the pattern cannot be produced. Therefore, it has been proposed that particles where magnetic particles are coated with a synthetic resin or mica coated with a magnetic material be used, in order to achieve reduction in weight for the magnetic particles. In this case, the specific weight of the magnetic particles is small, making it difficult for the magnetic particles to settle and aggregate, and thus, a uniform pattern can be produced, in comparison with the above described prior art. The synthetic resin and the mica are nonmagnetic particles, however, and therefore, the magnetic particles are not oriented as intended under some conditions at the time of application, and thus, a satisfactory appearance cannot be achieved. In order to solve this problem, a magnetic pattern forming coating composition has been proposed where the coating composition is set so that the solid component in the coating film one minute after application becomes 70 weight % or less as described in Japanese Laid-Open Patent Publication No. 2003-176452.

In the magnetic field forming means of the manufacturing apparatus described in Japanese Laid-Open Patent Publication No. 5-337424, however, the direction of the lines of magnetic force in the magnetic field is set approximately parallel to the surface of the coating film approximately in the center portion of the outline of a pattern, that is to say, approximately in the center portion between the end of the first magnet and the end of the second magnet. In other words, the extreme value (maximum value) of the lines of magnetic force directed from the N pole to the S pole is located approximately in the center portion between the end of the first magnet and the end of the second magnet. Therefore, the portion of the pattern created through orientation of magnetic particles in a magnetic field has a great width, making the pattern faint, and thus, distinctness cannot be achieved in the pattern. Furthermore, the magnetic particles located deep in the coating film are also oriented in the manner described above, and thus, a problem arises, such that appearance of depth cannot be achieved in the pattern and the appearance of movement resulting from shifting of the pattern when viewed from different angles is not satisfactory.

In the pattern forming coating composition described in Japanese Laid-Open Patent Publication No. 2003-176452, the coating composition is set so that the solid content of the coating composition one minute after application becomes only 70 weight % or less. Therefore, even when a magnetic field is applied and the magnetic particles in the coating composition are oriented in the direction of the lines of magnetic force, the viscosity of the coating composition does not subsequently increase sufficiently and the orientation of the magnetic particles is not maintained. Accordingly, a problem arises, that distinctness, depth appearance, and appearance of movement cannot be improved in the pattern due to disturbances during orientation of the magnetic particles.

SUMMARY OF THE INVENTION

An objective of the present invention is to provide a pattern forming apparatus and a pattern forming method where an excellent pattern having distinctness, depth appearance, and appearance of movement can be formed on a coating film which contains magnetic particles.

To achieve the foregoing objective and in accordance with one aspect of the present invention, a pattern forming apparatus for forming a pattern on a coating film having a front surface which is formed of a coating composition containing magnetic particles with flaky form is provided. The coating composition is applied to an article to be coated. The apparatus includes a plurality of adjacent sheet form magnets. The adjacent sheet form magnets include a front surface and a back surface having magnetic poles, a side surface, contact portions of the respective sheet form magnets, and a magnetic field created by the magnetic poles. The contact portions are formed by arranging the respective sheet form magnets along the front surface of the coating film in such a state that the magnetic poles on the front surface and the magnetic poles on the back surface of the adjacent sheet form magnets are different between the adjacent sheet form magnets, and side surfaces of the respective sheet form magnets contact each other. The magnetic field is applied to the coating film via the plurality of sheet form magnets. Magnetic particles in the coating film are oriented by the magnetic field. Magnetic particles above contact portions of the respective sheet form magnets are oriented substantially parallel to the front surface of the coating film. A pattern is formed on the coating film at least by the magnetic particles above contact portions of the respective sheet form magnets.

In accordance with another aspect of the present invention, a pattern forming method for forming a pattern on a coating film on an article is provided. The method includes: preparing a coating composition containing magnetic particles with flaky form; applying the coating composition the article to be coated and form the coating film on the article; arranging a plurality of sheet form magnets along the surface of the coating film with the magnets adjacent to each other, wherein each sheet form magnet has a side surface, a front surface, and a back surface, the front and back surfaces having magnetic poles, and wherein the sheet form magnets are arranged with the magnetic poles of adjacent sheet form magnets different between the front surface and the back surface of the sheet form magnets, and side surfaces of the sheet form magnets contact each other, and thus, the plurality of sheet form magnets are provided with contact portions of the sheet form magnets; and forming a pattern on the coating film by applying a magnetic field to the coating film using the plurality of sheet form magnets so that magnetic particles in the coating film are oriented by the magnetic field, wherein magnetic particles are oriented substantially parallel to the front surface of the coating film above the contact portions of the respective sheet form magnets, and a pattern is formed on the coating film at least by the magnetic particles above the contact portions of the respective sheet form magnets. The coating composition further contains a thermoplastic resin, a low boiling point solvent having a boiling point of 50° C. or higher and 100° C. or lower, and a high boiling point solvent having a boiling point of higher than 100° C. and 200° C. or lower. The coating composition ha a viscosity, between 20 seconds to 60 seconds after application of the coating composition to the article, that is 2,000 mPa·s to 500,000 mPa·s under normal conditions, the viscosity of the coating composition between 60 seconds and 120 seconds after application is 100,000 mPa·s or higher, and the viscosity of the coating composition between 60 seconds to 120 seconds after application is greater than the viscosity of the coating composition 20 seconds to 60 seconds after application.

DETAILED DESCRIPTION OF THE PREFERRED EMBODIMENTS

Figure 2:
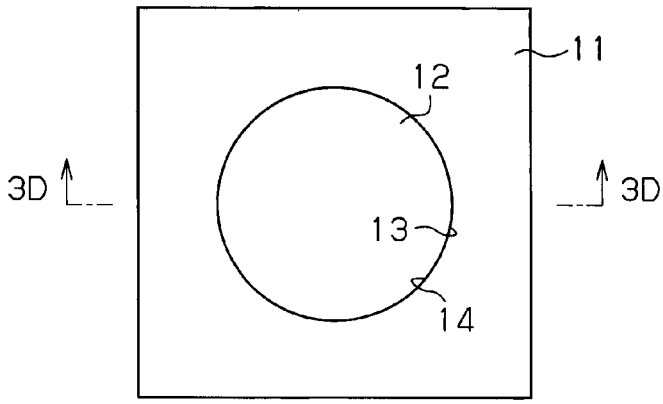
FIG. 2 is a plan view showing a state where the inner circumferential surface of the circular hole in a sheet form magnet having a circular hole and the outer circumferential surface of a magnet in circular sheet form contact each other.
Figure 3A:
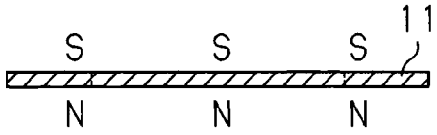
FIGS. 3A to 3D are diagrams showing the manufacturing process for a sheet form magnet.
Figure 3B:
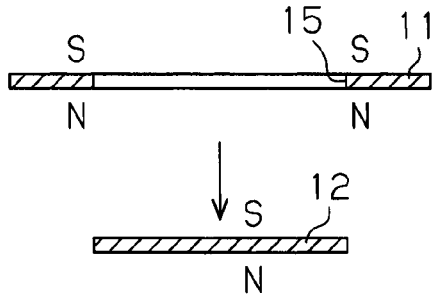
Figure 3C:
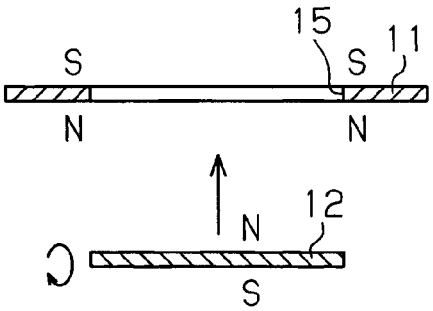
Figure 3D:
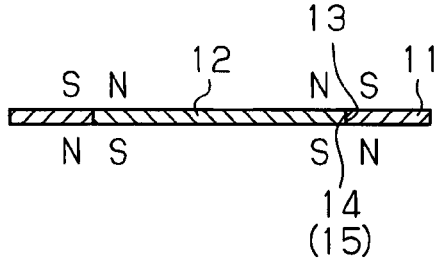

In the following, embodiments of the present invention will be described in detail in reference to the drawings. As shown in FIGS. 2 and 3D, a pattern forming apparatus is provided with a plurality of sheet form magnets. One sheet form magnet 11 from among the plurality of sheet form magnets has a rectangular (square) form as viewed from above this sheet form magnet 11, as well as a circular hole in the center portion, and the other sheet form magnet 12 in circular form is fitted into this hole. The sheet form magnet 11 may have a variety of thicknesses, and "sheet form" includes forms generally referred to as sheets and forms referred to as films and plates. In terms of the shape of the sheet form magnet 11, the magnet is not limited to having a rectangular shape, and may have a polygonal shape, for example triangular or hexagonal shapes, or circular or elliptical shapes. The shape of the pattern is determined by the shape of the sheet form magnet 12, and therefore, the sheet form magnet 12 may have a shape other than circular, or may be in the shape of letters, for example in the form of the letters N or A.

Figure 1:
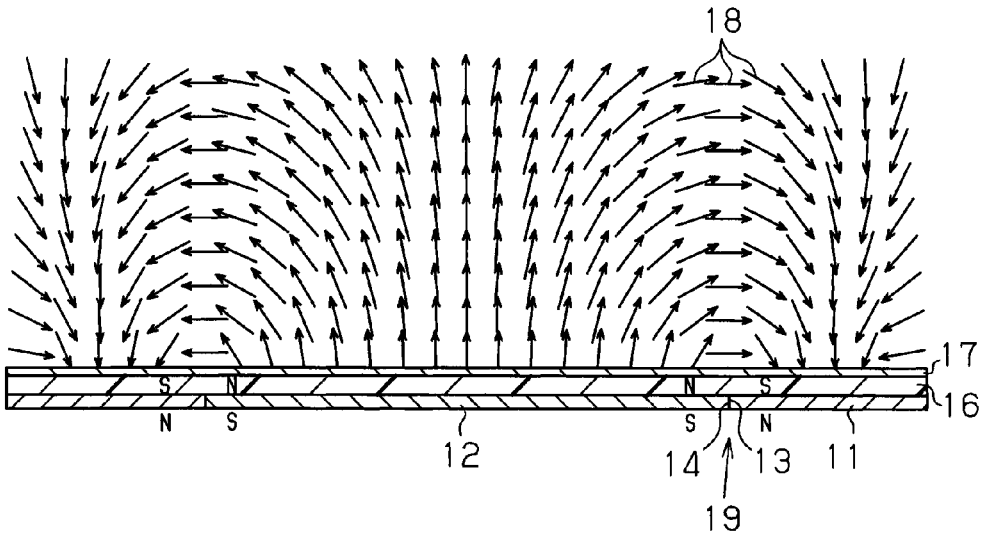
FIG. 1 is a diagram showing the lines of magnetic force when a coating film is formed on the front surface of an article to be coated, and a sheet form magnet is placed on the back surface of the article to be coated.

The sheet form magnet 12 has an N pole on the front surface (upper surface of the sheet form magnet 12 in FIGS. 1 and 3D) and an S pole on the back surface (lower surface of the sheet form magnet 12 in FIGS. 1 and 3D). The sheet form magnet 11, which is located around the sheet form magnet 12, has the S pole on the front surface and the N pole on the back surface. That is to say, the magnetic poles on the front surface of the adjacent sheet form magnet 12 and sheet form magnet 11 are different, as are the magnetic poles on the back surface of the adjacent sheet form magnet 12 and sheet form magnet 11. The outer circumferential surface (side surface) 13 of the sheet form magnet 12 and the inner circumferential surface (side surface) 14 of the sheet form magnet 11 contact each other. FIG. 3D is a cross sectional view along line 3D-3D in FIG. 2.

A pattern forming apparatus having the above described configuration is fabricated in the following manner. That is to say, as shown in FIG. 3A, the magnet 11 in rectangular sheet form is formed of a magnet sheet and is magnetized so as to have the S pole on the front surface and the N pole on the back surface. The magnet sheet is formed of a general material, such as plastic or rubber. Next, as shown in FIG. 3B, a separated magnetic sheet form sheet 12, which is a separation sheet in circular form, is punched out from the center portion of the sheet form magnet 11, in order to form a pattern in circular form. At this time, the hole 15 resulting from separation is created in the sheet form magnet 11 as a mark after separation of the sheet form magnet 12. Subsequently, as shown in FIG. 3C, the sheet form magnet 12 is reversed, so that the front surface and the back surface are switched. Finally, as shown in FIG. 3D, the sheet form magnet 12 that has been reversed is returned to and engaged in the hole 15 resulting from separation in the sheet form magnet 11. In this manner, a pattern forming apparatus where the adjacent sheet form magnets 11 and 12 have the magnetic poles reversed is gained. When a pattern is formed on a coating film using this pattern forming apparatus, respective symmetrical patterns in circular form are formed on the front surface and the back surface of the coating film.

The pattern forming apparatus may also be fabricated in accordance with the following method. That is to say, a magnet sheet which is not magnetized and can form a magnet in rectangular sheet form can be prepared, and the center portion of the magnet sheet can be punched out in circular form, in order to form a pattern in circular form. As a result, a separation sheet in circular form can be separated from the magnet sheet. At this time, the hole resulting from separation is created in the magnet sheet as a mark after separation of the separation sheet. Then, the magnet sheet and the separation sheet are respectively magnetized. At this time, the magnet sheet and the separation sheet are magnetized so as to have lines of magnetic force which extend in different directions from each other. Subsequently, the magnetized separation sheet is returned to and engaged in the hole resulting from separation in the magnet sheet. In this manner also, a pattern forming apparatus where the adjacent sheet form magnets 11 and 12 have the reversed magnetic poles is gained.

As shown in FIG. 1, a coating composition for forming a pattern which contains magnetic particles with flaky form (hereinafter simply referred to as coating composition) is applied to an article 16 to be coated in plate form made of a nonmagnetic material, and thus, a coating film 17 is formed, and the above described sheet form magnets 11 and 12 are placed along the coating film surface, which is the front surface of the coating film 17. That is to say, the sheet form magnets 11 and 12 are pasted on the back surface of the article 16 to be coated using an adhesive tape, or the sheet form magnets 11 and 12 are placed on top of the coating film 17 at a certain distance. In this state, the magnetic field created by the sheet form magnets 11 and 12 works on the magnetic particles in the coating film 17.

The above described coating composition contains a thermoplastic resin and a specific solvent, in addition to the magnetic particles with flaky form. The thermoplastic resin has excellent solubility in the solvent and such properties, in terms of the viscosity, that the viscosity of the coating composition increases exponentially as the solvent evaporates from the solution. As the thermoplastic resin having such properties in terms of the viscosity, vinyl acetate based resins, acryl based resins and cellulose acetate butyrate resins are preferable. As vinyl acetate based resins, vinyl acetate-vinyl chloride copolymer resins and ethylene-vinyl acetate copolymer resins may be used.

The magnetic particles are oriented along the lines of magnetic force of the magnetic field in the case where a magnetic field is applied while the coating composition is applied to an article to be coated or after application, and thus, form a pattern on the coating film. The magnetic particles have a flat form so that they reflect light; more concretely, a flake form, a plate form, a sheet form, or a film form. These magnetic particles are formed of a ferromagnetic material, such as iron oxide, nickel, cobalt or an alloy of these. As the magnetic particles, a pigment coated with a magnetic material may be used. That is to say, any well known pigment coated with a magnetic material, such as a magnetic metal, may be used as the magnetic particles. As the pigment, mica, mica coated with titanium dioxide, aluminum flakes, stainless steel flakes, alumina flakes and glass flakes may be used. As the magnetic metal, nickel, iron, cobalt and copper may be used. The magnetic particles have a length of approximately 1 μm to 80 μm and a thickness of approximately 0.1 μm to 20 μm.

The above described specific solvent contains a low boiling point solvent having a boiling point of 50° C. or higher and 100° C. or lower, and a high boiling point solvent having a boiling point of higher than 100° C. and 200° C. or lower. The low boiling point solvent and the high boiling point solvent are combined, so that the coating composition is set to have a solid component in a relatively low range of 5 mass % to 15 mass %, as described below, and thus, the following advantages can be gained. That is to say, the viscosity of the coating film on the article to be coated can be lowered immediately after application of the coating composition to the article to be coated, so that the solid component in the coating composition increases as the low boiling point solvent dramatically vaporizes as time elapses, and thus, the viscosity of the coating film increases exponentially. Therefore, the magnetic particles in the coating composition can be easily oriented by the lines of magnetic force immediately after application of the coating composition to the article to be coated, and after that, the state of the oriented magnetic particles can be easily maintained.

The viscosity of the coating film which is formed on the article to be coated is related to the rate of evaporation of the solvent, and furthermore, is related to the dissolving parameter (SP value) of the solvent. The rate of evaporation can be measured in the following manner. That is to say, an aluminum can having a radius of 5 mm is placed on a high precision scale. Thereafter, 0.1 g of n-butyl acetate is put in the aluminum can, and the time it takes for the weight to reduce by 90% through evaporation is measured, and this time is defined as 100, as the standard of the rate of evaporation. In the case where the time it takes for the solvent to reduce is shorter than the time it takes for n-butyl acetate to reduce, that is to say, in the case where it is easier for the solvent to evaporate than n-butyl acetate, the rate of evaporation of the solvent becomes 100 or higher. In the case where the time it takes for the solvent to reduce is longer than the time it takes for n-butyl acetate to reduce, that is to say, in the case where it is more difficult for the solvent to evaporate than n-butyl acetate, the rate of evaporation of the solvent becomes 100 or lower.

As the low boiling point solvent, methyl ethyl ketone (boiling point: 79.6° C., rate of evaporation: 465, SP value: 9.27), ethyl acetate (boiling point: 76.8° C., rate of evaporation: 525, SP value: 9.08), acetone (boiling point: 57° C., rate of evaporation: 720, SP value: 9.75) and isopropyl alcohol (boiling point: 82° C., rate of evaporation: 205, SP value: 11.5) may be used. As the high boiling point solvent, methyl isobutyl ketone (boiling point: 116.7° C., rate of evaporation: 160, SP value: 8.31), n-butyl acetate (boiling point: 126.3° C., rate of evaporation: 100, SP value: 8.47), xylene (boiling point: 142° C.), diisobutyl ketone (boiling point: 168.2° C., rate of evaporation: 18, SP value: 8.22), ethylene glycol monobutyl ether (boiling point: 192° C., rate of evaporation: 3, SP value: 8.9), isobutyl acetate (boiling point: 118° C., rate of evaporation: 175, SP value: 8.42) and propylene glycol monomethyl ether acetate (boiling point: 146° C., rate of evaporation: 40, SP value: 9.2) may be used.

It is preferable for a combination of a first high boiling point solvent having a boiling point of higher than 100° C. and 150° C. or lower, and a second high boiling point solvent having a boiling point of higher than 150° C. and 200° C. or lower, to be used as the above described high boiling point solvent, in that the amount of evaporation of the solvent after application of the coating composition can be finely adjusted and the viscosity of the coating composition can be easily controlled. As the first high boiling point solvent, as above, methyl isobutyl ketone (boiling point: 116.7° C.), n-butyl acetate (boiling point: 126.3° C.) and xylene (boiling point: 142° C.) may be used. As the second high boiling point solvent, ethylene glycol monobutyl ether (boiling point: 192° C.) and diisobutyl ketone (boiling point: 168.2° C.) may be used.

It is preferable for the coating composition to contain a dye or a pigment as a coloring agent, in that the decorative feel can be enhanced in the pattern on the coating film. As the dye, monoazo dyes, disazo dyes, metal complex salt azo dyes, anthraquinone dyes, indigo based dyes, phthalocyanine dyes, pyrazolone dyes, stilbene dyes, thiazole dyes, quinoline dyes, diphenyl methane dyes, triphenyl methane dyes, acridine dyes, xanthene dyes, azine dyes, thiazine dyes, oxazine dyes, polymethine dyes, indophenol dyes and perylene dyes may be used. As the pigment, organic based pigments, metal powder pigments and photoluminescent pigments may be used. As organic based pigments, azolake based pigments, insoluble azo based pigments, condensation azo based pigments, phthalocyanine based pigments, perylene based pigments, dioxazine based pigments, indigo based pigments, quinacridone based pigments, isoindorinone based pigments, benzimidazolone based pigments, diketopyrrolopyrole based pigments, and metal complex pigments may be used. As metal powder pigments, yellow iron oxide, red iron oxide, carbon black and titanium dioxide may be used. As photoluminescent pigments, interference mica and coloring mica may be used.

The coating composition may contain a curing agent, such as an amine resin, an isocyanate compound or a block isocyanate compound thereof, an epoxy compound or polycarbodiimide, and in this case, the above described thermoplastic resin can be cured using these. Furthermore, the coating composition may contain components which are mixed with general coating compositions, such as an antioxidant, a leveling agent, an antifoaming agent, a thickener, or ultraviolet absorbers.

It is preferable for the content of thermoplastic resin in the solid component of the coating composition to be 60 mass % to 93 mass % and for the content of the magnetic particles to be 7 mass % to 35 mass %. In the case where the amount of thermoplastic resin mixed in is less than 60 mass %, there is a risk that the smoothness of the coating film may be lost or the adhesiveness of the coating film to the article to be coated may lower. In the case where the content of the thermoplastic resin exceeds 93 mass %, the amount of the magnetic particles mixed in becomes relatively small, and there is a risk that it may not be possible for a desired pattern to be formed on the coating film. In the case where the content of the magnetic particles is less than 7 mass %, the color and the pattern of the article to be coated are easily affected, because of the low content of the magnetic particles, and it is difficult for a beautiful pattern to be gained, to a lack of magnetic particles oriented through application of a magnetic field when the coating composition is applied. In the case where the content of the magnetic particles exceeds 35 mass %, the magnetic particles become excessive and there is a risk that orientation may be hindered rather than aided, magnetic particles may settle or aggregate during application, or the internal force of aggregation in the coating film may lower, causing aggregation breakdown.

It is preferable for the upper limit for the content of the dye which is a coloring agent to be 33 mass % in the solid content of the coating composition. In this case, it is preferable for the sum of the content of the coloring agent and the content of the above described magnetic particles to be 7 mass % to 40 mass % in the solid. In the case where the content of the coloring agent exceeds 33 mass %, there is a risk that the dispersibility of the coloring agent in the coating composition may become low, the color of the coating film may become excessively strong, or the balance of the content in relation to other components may become worse.

It is preferable for the content of nonvolatile components in the coating composition, that is to say, the content of the solid components, to be 5 mass % to 15 mass %, so that the initial viscosity of the coating composition after application of the coating composition becomes low and orientation of the magnetic particles is accelerated along the lines of magnetic force. In the case where the content of the nonvolatile components is less than 5 mass %, the viscosity of the coating composition does not sufficiently increase, even after time has elapsed after application of the coating composition, and thus, the coating composition sags, or it becomes difficult for the orientation of the magnetic particles to be maintained. In the case where the content of the nonvolatile components exceeds 15 mass %, the initial viscosity of the coating composition after application of the coating composition cannot be sufficiently lowered.

A thermoplastic resin solution is prepared, and after that, magnetic particles are mixed into the thermoplastic resin solution so that a coating composition base is prepared, and then, the coating composition base is diluted with a diluting solvent in which a low boiling point solvent and a high boiling point solvent are mixed as described above, and thus, a coating composition is prepared. In this case, it is preferable for the coating composition to be sufficiently stirred during the preparation of the resin solution, mixing in of the magnetic particles and diluting with the diluting solvent, so that the thermoplastic resin is well dissolved and the magnetic particles are well dispersed. A dispersing agent, for example, may be used to disperse the magnetic particles, as long as the adhesiveness of the coating film is not affected. Though the composition of the diluting solvent and the amount of the coating composition base and the diluting solvent mixed in are not particularly limited, the coating composition is set so as to satisfy the above described conditions for the viscosity of the coating composition after application.

Preferably, the above described diluting solvent contains 40 mass % to 75 mass % of a low boiling point solvent, 5 mass % to 10 mass % of a first high boiling point solvent, and 20 mass % to 55 mass % of a second high boiling point solvent. The content of the low boiling point solvent is set high, so that the initial viscosity of the coating composition after application can be lowered, making orientation of the magnetic particles easy. In addition, the content of the second high boiling point solvent is set relatively high, so that increase in the viscosity of the coating composition after application can be accelerated. Furthermore, a small amount of the first high boiling point solvent is mixed in, so that the viscosity of the coating composition can be controlled with high precision. Coating composition having such a composition is usually set so that the viscosity is as low as 60 mPa·s to 80 mPa·s, and thus, the work of applying the coating composition becomes easy.

The coating composition is set so that the viscosity becomes 2,000 mPa·s to 500,000 mPa·s 20 seconds to 60 seconds after application on the front surface of an article to be coated under normal conditions. In this manner, the initial viscosity after application of the coating composition is set relatively low, and thus, the magnetic particles can be oriented along the lines of magnetic force when a magnetic field is applied. Normal conditions refer to an atmosphere (environment) where the temperature is 15° C. to 35° C. and the relative humidity is 40% to 90%. In the case where the above described viscosity of the coating composition is less than 2,000 mPa·s, the viscosity of the coating composition is too low, making the fluidity of the applied coating composition great, and thus, the coating composition sags, making the work of applying the coating composition difficult, and a desired thickness cannot be gained for the coating film. In the case where the above described viscosity of the coating composition exceeds 500,000 mPa·s, the viscosity of the coating composition becomes too high, preventing orientation of the magnetic particles, and thus, distinctness, the depth appearance and the appearance of movement cannot be gained for the pattern formed on the coating film.

The coating composition is set so that the viscosity between 60 seconds and 120 seconds after application becomes 100,000 mPa·s or higher. In the case where the viscosity of the coating composition is 100,000 mPa·s or higher, the viscosity of the coating composition is too high to measure, and the coating composition solidifies. The coating composition is set so as to have a high viscosity during the above described time period, and thus, the magnetic particles can be fixed in an oriented state. In the case where the viscosity of the coating composition during the above described time period is less than 100,000 mPa·s, the orientation of the magnetic particles in the magnetic field cannot be kept as it is, and the target pattern cannot be gained on the coating film, due to disturbance in the orientation.

The coating composition is set so that the viscosity of the coating composition between 60 seconds and 120 seconds after application is greater than the viscosity of the coating composition between 20 seconds to 60 seconds after application. That is to say, the coating composition is set so that the viscosity in the later stage is higher than the initial viscosity after application. As a result, orientation of the magnetic particles can be achieved and the orientation can be fixed. In the case where the viscosity of the coating composition is set in the opposite manner, the magnetic particles cannot be oriented along the lines of magnetic force, and the magnetic particles cannot be fixed. In the case where the coating composition is applied to an article to be coated, the above described respective conditions for the viscosity can be satisfied, and the coating composition can be intentionally treated through such a means as application of heat. In this case, the viscosity of the coating composition can be adjusted drastically. The thickness of the thus gained coating film is approximately 5 μm to 50 μm when dry.

The arrows in FIG. 1 represent the lines of magnetic force (magnetic field) 18 which extend from the N pole of the sheet form magnet 12 toward the S pole of the sheet form magnet 11. As indicated by these arrows, the lines of magnetic force 18 are oriented substantially parallel to the coating film surface above portions 19 where the two sheet form magnets 11 and 12 contact each other. In other words, the extreme value (maximum value) of the lines of magnetic force 18 which close the magnetic poles of the adjacent sheet form magnets 11 and 12 is located above the portions 19 where adjacent sheet form magnets 11 and 12 contact each other. Therefore, the magnetic particles dispersed in the coating film 17 on the article to be coated 16 are oriented in the direction in which the lines of magnetic force 18 extend due to the magnetic field resulting from the adjacent sheet form magnets 11 and 12. Accordingly, the magnetic particles are oriented substantially parallel to the surface of the coating film in the portions 19 where the two sheet form magnets 11 and 12 contact each other. As a result, light from above the coating film 17 is most easily reflected from the portion 19 where the two sheet form magnets 11 and 12 contact each other, because of the magnetic particles in the coating film 17, and thus, the coating film surface appears bright and clear.

The reason why distinctness, depth appearance, and appearance of movement can be achieved in the pattern on the coating film 17 using the pattern forming apparatus according to the present embodiment is described with reference to FIGS. 5 and 6. When the coating film 17 is seen from directly above, a clear, circle pattern 21 appears, as indicated by the solid lines in FIG. 6. As the eye moves to the right in FIG. 6, this circle pattern 21 moves to the right (two-dot chain lines). The distance L over which the pattern 21 moves is the distance of movement.

Figure 5:
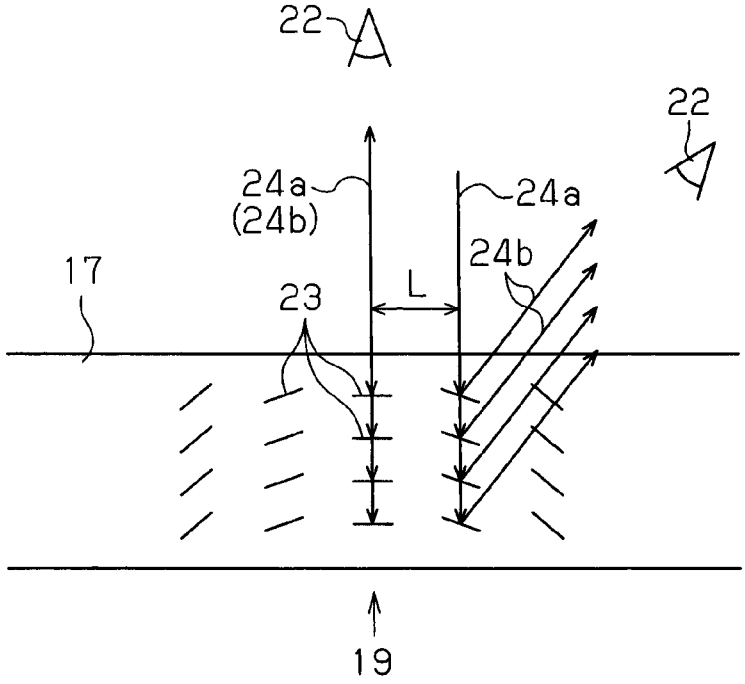
FIG. 5 is a schematic diagram for explaining the distinctness, depth appearance, and appearance of movement of a pattern on a coating film.
Figure 6:
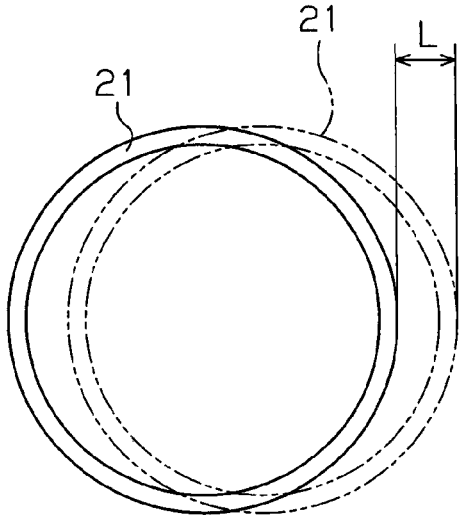
FIG. 6 is a diagram for explaining the pattern on a coating film and movement of the coating film.

As shown in FIG. 5, when the coating film 17 is seen by the eye 22 from directly above, incident light 24*a* strikes and is reflected from the magnetic particles 23 which are oriented in the horizontal direction, from among the magnetic particles 23 in the coating film 17, so that reflected light 24*b* is directed directly upward and enters into the eye 22. At this time, the magnetic particles 23 which are oriented in the horizontal direction are uniformly oriented, and therefore, light 24*b* reflected from these magnetic particles 23 is intensified. Accordingly, the above described circle pattern 21 can be clearly seen. Furthermore, the magnetic particles 23 in deep portions (lower portion in FIG. 5) of the coating film 17 are also oriented in the horizontal direction, and therefore, light 24*b* reflected from these magnetic particles 23 also enters into the eye, and thus, the pattern 21 appears to have depth appearance.

Subsequently, as the eye 22 moves to the right in FIG. 5 (by approximately 45 degrees), incident light 24*a* striking magnetic particles 23 which are inclined to the right (by approximately 22.5 degrees) from among the magnetic particles 23 is reflected, so that the reflected light 24*b* can be seen by the eye 22. At this time also, the magnetic particles 23 which are inclined to the right are uniformly oriented at the same angle, and therefore, light 24*b* reflected from these magnetic particles 23 is intensified, and thus, the pattern 21 can be clearly seen. Accordingly, the pattern 21 appears as though it has moved by the distance of movement L.

Figure 7:
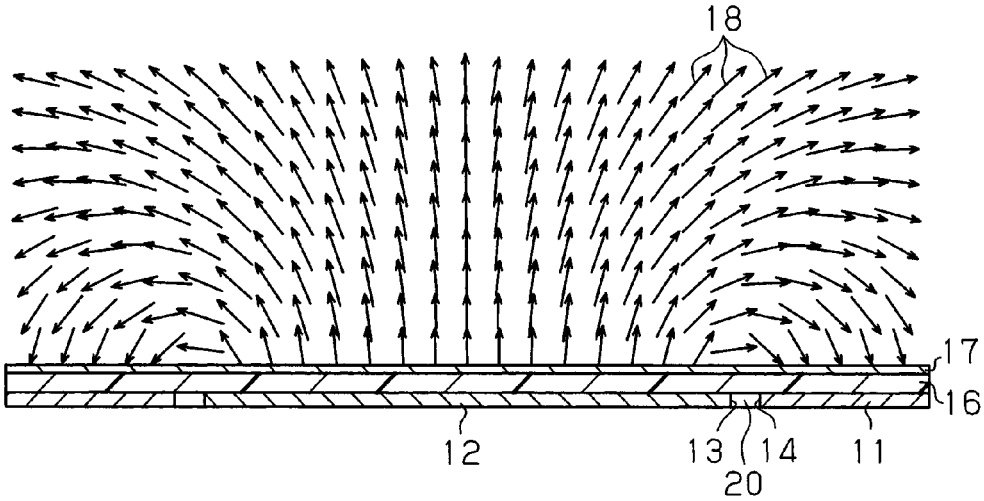
FIG. 7 is a diagram showing the lines of magnetic force when a coating film is formed on the front surface of an article to be coated, and sheet form magnets are placed adjacently at intervals on the back surface of the article to be coated.

As shown in FIG. 7, in the case where the adjacent sheet form magnets 11 and 12 do not contact each other and a space 20 is provided between the inner circumferential surface 14 of the sheet form magnet 11 and the outer circumferential surface 13 of the sheet form magnet 12, the lines of magnetic force 18 which close the two sheet form magnets 11 and 12 follow arcs having a greater radius (curvature radius). In addition, the location where the direction of the lines of magnetic force 18 is parallel to the coating film surface is approximately the center portion of the outline of the pattern, that is to say, approximately the center portion between the inner circumferential surface 14 of the sheet form magnet 11 and the outer circumferential surface 13 of the sheet form magnet 12. Therefore, the pattern created as a result of the orientation of the magnetic particles 23 has a great width and becomes vague. Furthermore, the magnetic particles 23 which are located in deep portions of the coating film 17 are oriented in the same manner as the magnetic particles 23 in the surface of the coating film 17, and thus, neither depth appearance nor an appearance of movement can be achieved for the pattern.

Figure 8:
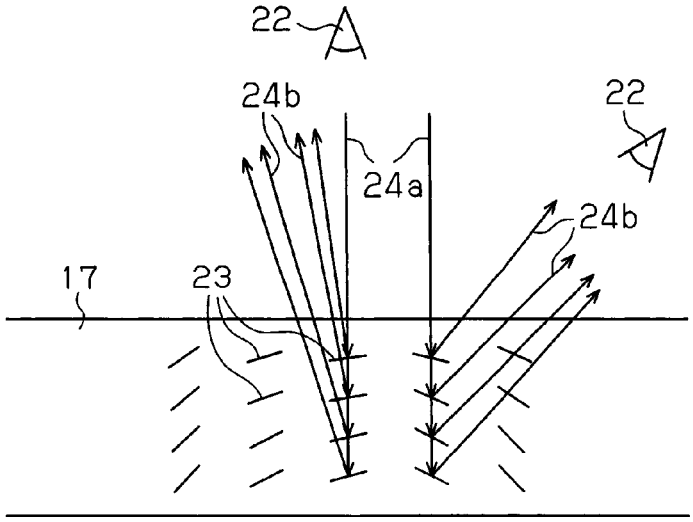
FIG. 8 is a schematic diagram for explaining the state of light reflected from magnetic particles in a coating film in the case where sheet form magnets are placed adjacently at intervals.

This is further described in reference to FIG. 8. In cases as that shown in FIG. 8, the magnetic particles 23 exhibit a certain directivity, and the magnetic particles 23 are not oriented uniformly, and thus, reflected light 24*b* is not oriented uniformly and the pattern 21 cannot be clearly seen when the coating film 17 is viewed from directly above by the eye 22 and when the coating film 17 is seen with the eye 22 moved to the right. Accordingly, even in the case where there are some portions where the pattern 21 can be clearly seen when the eye 22 moves, these portions are partial, and the locations thereof are not stable, and thus, no substantial appearance of movement can be achieved.

The adjacent sheet form magnets 11 and 12 are placed in such a state that the magnetic poles on the front surface and the back surface are different between the two, and the two contact each other. A coating composition containing magnetic particles 23 is applied to the front surface of an article to be coated, and thereby, the coating film 17 is formed. Sheet form magnets 11 and 12 are pasted on the back surface of the article to be coated 16. A magnetic field is applied to the coating film 17 by means of the sheet form magnets 11 and 12. The lines of magnetic force 18 created by this magnetic field originate from the N pole of one sheet form magnet 12 and reach the S pole of the other sheet form magnet 11, and have the extreme value above the portions 19 where the two sheet form magnets 11 and 12 contact each other.

A thermoplastic resin is dissolved in an organic solvent into which magnetic particles 23 are then mixed, and thus, a coating composition base is prepared, and then, the coating composition base is diluted with a diluting solvent in which a predetermined low boiling point solvent and a high boiling point solvent are mixed, and thereby, the coating composition is prepared. When the thus prepared coating composition is applied to an article to be coated 16, the initial viscosity of the coating composition after application of the coating composition is relatively low, because of the low boiling point solvent included in the solvent, and thus, the magnetic particles 23 are quickly oriented so as to become of a such state as to be oriented uniformly with precision in the direction of the lines of magnetic force 18 by the magnetic field, even in a small region. In the later stage after application of the coating composition, the low boiling point solvent quickly evaporates, making the viscosity of the coating composition increase drastically, and therefore, the oriented magnetic particles 23 are fixed in this state.

The magnetic particles 23 which are located above the portions 19 where the sheet form magnets 11 and 12 contact each other are oriented substantially parallel to the coating film surface. When light strikes the magnetic particles 23 oriented in the same direction in the coating film 17, the reflected light 24*b* is oriented in the same direction, and therefore, the contrast between bright portions resulting from intense reflected light 24*b* and dark portions without reflected light 24*b* becomes high, making the border portions of the pattern 21 clear. In addition, the magnetic particles 23 in deep locations in the coating film 17 are oriented in the same direction as the magnetic particles 23 in shallow locations, and therefore, light 24*b* reflected from the magnetic particles 23 in deep locations can be seen together with light 24*b* reflected from magnetic particles 23 in shallow locations, and thus, the pattern has appearance of depth. Additionally, when the eye moves, the direction of the article to be coated 16 is changed or the direction of light changes, light 24*b* reflected from the magnetic particles 23 in other locations which are oriented in the same direction can be seen, and thus, the pattern 21 appears as though it were moving.

The above described embodiment has the following advantages.

In the pattern forming apparatus according to the present embodiment, sheet form magnets 11 and 12 are placed along the coating film surface on an article to be coated 16 in such a state as to contact each other where the magnetic poles on the front surface and the magnetic poles on the back surface are different between the adjacent sheet form magnets 11 and 12. In addition, the magnetic particles 23 in the portions 19 where the two sheet form magnets 11 and 12 contact each other are oriented substantially parallel to the coating film surface. Accordingly, the portions 19 where the sheet form magnets 11 and 12 make a clear pattern appear on the coating film 17, and at the same time, an excellent pattern, particularly in terms of depth appearance, and appearance of movement, can be formed. Furthermore, the magnetic particles 23 are oriented in the same direction in portions other than the portions 19 where the sheet form magnets 11 and 12 contact each other, and therefore, the respective portions have the same advantages as the contact portions 19.

The pattern forming apparatus is gained in the following steps. That is to say, a magnet sheet which is not magnetized is cut into a predetermined pattern, so that a separate sheet is separated from the magnet sheet. At this time, a hole resulting from separation is created in the magnet sheet. Next, the magnet sheet and the separation sheet are respectively magnetized. At this time, the magnet sheet and the separation sheet are magnetized so as to have lines of magnetic force which extend in different directions. Subsequently, the magnetized separation sheet is returned to and engaged in the hole resulting from separation in the magnet sheet. In these steps, a pattern forming apparatus can be easily manufactured.

A pattern forming apparatus can also be realized by the following steps. Specifically, a sheet form magnet 11 which has been magnetized is cut along the lines of a pattern in circular form so that a sheet form magnet 12 is separated from the sheet form magnet 11. Next, the sheet form magnet 12 can be reversed, so that the front surface and the back surface are switched, and after that, the sheet form magnet 12 can be returned to and engaged in the hole 15 resulting from separation in the sheet form magnet 11. In these steps, a pattern forming apparatus can be easily manufactured through a single magnetization operation.

In accordance with the pattern forming method according to the present embodiment, the adjacent sheet form magnets 11 and 12 are arranged so that the respective magnetic poles are different on the front surface and the back surface, and the side surfaces of the sheet form magnets 11 and 12 contact each other. Then, the above described sheet form magnets 11 and 12 are placed along the a coating film surface formed by applying a coating composition containing magnetic particles 23 in flat form on an article to be coated 16, and a magnetic field is applied to the coating composition film 17 by means of the sheet form magnets 11 and 12. Therefore, the magnetic particles 23 in the portions 19 where the sheet form magnets 11 and 12 contact each other are oriented substantially parallel to the coating film surface, and the magnetic particles 23 in deep portions in the coating film 17 are oriented in the same direction as the magnetic particles 23 in the surface portion. Accordingly, the portions 19 where the sheet form magnets 11 and 12 contact each other make a clear pattern 21 appear on the coating film 17, and at the same time, an excellent pattern in terms of depth appearance, and appearance of movement can be formed.

Furthermore, the coating composition contains a low boiling point solvent having a boiling point of 50° C. or higher and 100° C. or lower, and a high boiling point solvent having a boiling point of higher than 100° C. and 200° C. or lower. The coating composition is set so that the viscosity of the coating composition 20 seconds to 60 seconds after application becomes 2,000 mPa·s to 500,000 mPa·s, and the viscosity of the coating composition between 60 seconds and 120 seconds after application becomes no lower than 100,000 mPa·s. Furthermore, the coating composition is set so that the viscosity of the coating composition between 60 seconds and 120 seconds after application becomes greater than the viscosity of the coating composition between 20 seconds and 60 seconds after application. Accordingly, the magnetic particles 23 are easy to orient in the direction of the lines of magnetic force 18, even in the case where the area of the contact portions 19 between the sheet form magnets 11 and 12 are small and the oriented state of the magnetic particles 23 after orientation is kept as it is when the coating composition has a high viscosity or is solidified. As described above, the sheet form magnets 11 and 12 are arranged and combined with a specific coating composition, and thus, the coating film 17 has an excellent pattern 21 in terms of distinctness, depth appearance, and appearance of movement.

The pattern 21 is formed of the magnetic particles 23 oriented by a magnetic field in the vicinity of the contact portions 19 between the adjacent sheet form magnets 11 and 12, and thus, the above described advantages can be gained, particularly in the contact portions 19 between the sheet form magnets 11 and 12.

The extreme value of the lines of magnetic force 18 which close the magnetic poles of the adjacent sheet form magnets 11 and 12 is located above the contact portions 19 between the adjacent sheet form magnets 11 and 12, and thus, the lines of magnetic force 18 extend in the direction of the coating film surface in the contact portions 19 between the adjacent sheet form magnets 11 and 12, and extend in the same direction as that described above in the magnetic particles 23 within the coating film 17, and can be clearly differentiated from those in other portions within the coating film 17. Accordingly, the above described advantages can further be improved in the contact portions 19 between the sheet form magnets 11 and 12.

The thermoplastic resin in the coating composition is a vinyl acetate based resin, an acryl based resin or a cellulose acetate butyrate resin, and thus, the viscosity of the coating composition can be easily controlled, because of the properties of these resins.

The nonvolatile components in the coating composition are set in a range of as little as 5 mass % to 15 mass %, and thus, the initial viscosity of the coating composition after application can be made low, so that the magnetic particles 23 can be easily oriented.

The coating composition contains a dye or a pigment as a coloring agent, and thus, the coating film 17 can be colored, so that the above described advantages can be improved.

The article to be coated 16 is in sheet form, and thus, the magnetic field of the sheet form magnets 11 and 12 can be uniformly applied to the magnetic particles in the coating film 17.

The coating film surface is flat, and thus, no extra light is reflected from the coating film surface.

The above described embodiment may be modified in the following manner.

Three or more magnets as the above described sheet form magnets may be used, so that the respective sheet form magnets are arranged in such a manner that the magnetic poles are different between the adjacent sheet form magnets. In this case also, the pattern formed on the coating film 17 can be changed.

In the case where the article to be coated 16 has a curved front surface and the coating film 17 is formed on this surface, the sheet form magnets 11 and 12 may be placed and curved along the front surface of the coating film 17.

The orientation of the magnetic particles 23 (appearance of the pattern 21) is measured in advance on the basis of the relationship between the intensity of the magnetic field of the sheet form magnets 11 and 12 and the thickness of the article to be coated 16, between the intensity of the magnetic field of the sheet form magnets 11 and 12 and the thickness of the coating film 17, as well as between the intensity of the magnetic field of the sheet form magnets 11 and 12 and the concentration of the magnetic particles 23, and this data may be used for the formation of a desired pattern 21.

The magnetic particles 23 may be provided by combining a plurality of types of magnetic particles 23 made of different materials or a plurality of types of magnetic particles 23 having different sizes. In this case, the pattern 21 becomes more original.

The above described diluting solvent may be provided respectively using a plurality of first high boiling point solvents and second high boiling point solvents, so that the viscosity of the coating composition can be adjusted more finely.

When a pattern is formed on a coating film using the above described pattern forming apparatus, a coating composition of which the viscosity under the above described conditions exceeds the above described range may be used.

In the following, the above described embodiment is described more concretely by citing examples and comparative examples. The present invention is not limited to these examples. In the respective examples and comparative examples, parts refer to parts by mass and % refer to mass %, unless otherwise stated. First, the three types of coating composition bases described in the following were prepared.

(Coating Composition Base A)

A mixture of 384.2 parts of methyl isobutyl ketone (MIBK) and 164.5 parts of methyl ethyl ketone (MEK) was put in a container made of stainless steel with a stirring apparatus attached, and 128.1 parts of a vinyl acetate-vinyl chloride copolymer resin (trade name: VMCH, made by Dow Chemical Co., Ltd.) was added to the mixture while it was being stirred, and thus, a resin solution was prepared. Subsequently, 71.9 parts of xylene and 18 parts of a dye (trade name: Plast Blue 8550, made by Arimoto Chemical Co., Ltd.) were added and dissolved while the mixture was being well stirred. Next, 22.5 parts of magnetic particles (iron oxide in plate form or flake powder form, trade name: AM-200, made by Titanium Industry Co., Ltd.) were added, and 210.8 parts of n-butyl acetate were further added while the mixture was being stirred, and the mixture was sufficiently stirred, and thus, a coating composition base A was gained. The nonvolatile content in the coating composition base A was 17%.

(Coating Composition Base B)

A coating composition base B was prepared in accordance with the same method as for the coating composition base A, by adding the following materials in sequence. The nonvolatile content in the coating composition base A was 17%.

| | |
|---|---|
| Acryl resin solution a described as follows: | 120 parts |
| Acryl resin solution b described as follows: | 90 parts |
| Rheological agent (trade name: AZS-522, made by Nippon Paint Co., Ltd.) | 40 parts |
| Anthraquinone based dye (same as in coating composition A) | 20 parts |
| Magnetic particles (trade name: AM-200, made by Titanium Industry Co., Ltd.) | 22 parts |
| Ethyl acetate | 245 parts |
| Xylene | 100 parts |
| n-butyl acetate | 286 parts |

(Coating Composition Base C)

The materials described as follows were added in sequence in accordance with the same method as for the coating composition base A, and thus, a coating composition base C was gained. The nonvolatile content of the coating composition base C was 17%.

| | |
|---|---|
| Acryl resin solution a described as follows: | 120 parts |
| Acryl resin solution b described as follows: | 90 parts |
| Rheological agent (trade name: AZS-522, made by Nippon Paint Co., Ltd.) | 40 parts |
| Phthalocyanine pigment paste (made by Nippon Bee Chemical Co., Ltd., of of a phthalocyanine pigment, 57.0 parts of acryl resin solution a described in the following, 2.3 parts of ethylene glycol monobutyl ether, 8.8 parts of methyl isobutyl ketone and 8.8 parts of toluene, where the solid content of the pigment paste was 48%, the concentration of the pigment in the pigment paste was 16.5% and the concentration of the pigment in the solid content of the pigment paste was 34.4 ) | 20 parts<br>16.5 parts |
| Magnetic particles (trade name: AM-200, made by Titanium Industry Co., Ltd.) | 22 parts |
| Ethyl acetate | 230 parts |
| Xylene | 90 parts |
| n-butyl acetate | 253 parts |

(Acryl Resin Solution a)

A mixture of 17 parts of toluene and 10 parts of n-butyl acetate was put in a polymerization reaction container having a stirring machine, a thermometer, a reflux pipe, a dropping funnel, a nitrogen introduction pipe and a heating apparatus with a thermostat, and while they were being stirred, the temperature was gradually increased to 110° C. Next, a monomer mixture solution of 40 parts of methyl methacrylate, 15 parts of styrene, 7 parts of 2-hydroxy ethyl methacrylate, 37 parts of ethyl hexyl acrylate and 1 part of methacrylic acid and a polymerization initiator solution made of 15 parts of toluene, 5 parts of n-butyl acetate and 0.8 parts of t-butyl peroxy-2-ethyl hexanate were respectively put in separate dropping funnels so that they were dropped over a period of three hours, and thus, a polymerization reaction occurred. During this time, the polymerization reaction solution was being stirred and the temperature was maintained at 110° C.

Subsequently, a polymerization initiator solution made of 5 parts of toluene, 5 parts of n-butyl acetate and 0.2 parts of t-butyl peroxy-2-ethyl hexanate was dropped over a period of two hours while the temperature of the polymerization reaction solution was maintained at 110° C. After that, the temperature of the polymerization reaction solution was lowered to 80° C., 33 parts of toluene and 10 parts of n-butyl acetate were added in sequence, and thus, an acryl resin solution (acryl resin varnish) a was gained. The resin solid content of this acryl resin solution a was 50% and the mass average molecular weight was 49,000 through the conversion of the results of measurement using gel permeation chromatography to its equivalent in polystyrene standard. The resin solid content was calculated in the following.

$$\text{Resin solid content (\%)}=(Y/X)\times 100$$

In the above described formula, X is the amount of sample of the acryl resin solution a (g), and Y is the mass of the sample of acryl resin solution a after being dried in a drying oven for three hours at 110° C. (g).

(Acryl Resin Solution b)

20 parts of xylene and 10 parts of MIBK were put in a polymerization reaction container having a stirring machine, a thermometer, a reflux pipe, a dropping funnel, a nitrogen introduction pipe, and a heating apparatus with a thermostat, and while they were being stirred, the temperature was gradually increased to 130° C. Next, a monomer mixture solution of 61 parts of methyl methacrylate, 15 parts of styrene, 2.5 parts of 2-hydroxy ethyl methacrylate, 20 parts of ethyl hexyl acrylate and 1.5 parts of methacrylic acid and a polymerization initiator solution made of 20 parts of xylene, 10 parts of MIBK and 1.1 parts of t-butyl peroxy-2-ethyl hexanate were respectively put in separate dropping funnels so that they were dropped over a period of three hours, and thus, a polymerization reaction occurred. During this time, the polymerization reaction solution was being stirred and the temperature was maintained at 130° C.

Subsequently, a polymerization initiator solution made of 10 parts of xylene, 5 parts of MIBK and 0.4 parts of t-butyl peroxy-2-ethyl hexanate was dropped over a period of two hours while the temperature of the polymerization reaction solution was maintained at 130° C. After that, the temperature of the polymerization reaction solution was lowered to 80° C., 10 parts of xylene and 15 parts of MIBK were added in sequence, and thus, an acryl resin solution (acryl resin varnish) b was gained. The resin solid content of this acryl resin solution b was 50% and the mass average molecular weight was 16,000 through the conversion of the results of measurement using gel permeation chromatography to its equivalent in polystyrene standard. The resin solid content was calculated in the same manner as for the acryl resin solution a.

(Diluting Solvent)

Methyl ethyl ketone, ethyl acetate, n-butyl acetate and diisobutyl ketone were used, and thus, the three types of diluting solvents: α, β and γ shown in Table 1 were prepared.

TABLE 1

| | Diluting Solvent α | Diluting Solvent β | Diluting Solvent γ |
|---|---|---|---|
| Methyl Ethyl Ketone (%) | 23 | 23 | 23 |
| Ethyl Acetate (%) | 39 | 19 | 51 |
| n-Butyl Acetate (%) | 6 | 6 | 6 |
| Diisobutyl Ketone (%) | 32 | 52 | 20 |

EXAMPLE 1

Four commercially available ABS resin plates (black; length: 20 cm, width: 15 cm, thickness: 0.1 cm) were prepared as articles to be coated 16, and the front surface of each resin plate was wiped with isopropyl alcohol. Meanwhile, the center portion of a magnet 11 in rectangular sheet form which was magnetized (square having sides of 65 mm and a thickness of 2.1 mm) was punched out in circular form, so that a sheet form magnet 12 (diameter: 40 mm) was separated from the sheet form magnet 11, and the sheet form magnet 12 was reversed and returned to and engaged in the hole 15 resulting from separation in the sheet form magnet 11, which was used as a plurality of sheet form magnets. That is to say, sheet form magnets were used where the inner circumferential surface 14 of the sheet form magnet 11 and the outer circumferential surface 13 of the sheet form magnet 12 contact each other. The sheet form magnets 11 and 12 were pasted on the back surface of one ABS resin plate using an adhesive tape in such a manner that the N pole side of the sheet form magnet 12 made contact with the back surface of the ABS resin plate before application of the coating composition. This was used as a test piece for a coating film with a pattern. The remaining three ABS resin plates were used to measure the viscosity of the coating composition 30 seconds, 60 seconds and 90 seconds after application. The coating composition for forming a pattern according to Example 1 was prepared by mixing and stirring 100 parts of the above described coating composition A and 100 parts of the diluting solvent α. The nonvolatile content at the time of application of this coating composition for forming a pattern was 8.5%.

Then, a spray gun (trade name: Wider 100, made by Anest Iwata Corporation) was used in an atmosphere where the temperature was 20° C. and the relative humidity (RH) was 65%, and the coating composition for forming a pattern was sprayed against and applied to the front surfaces of the above described four ABS resin plates so that the dried film thickness was approximately 10 μm. The test pieces for the coating film with a pattern were left for 10 minutes in the above described atmosphere. Meanwhile, as for the three ABS resin plates for measuring the viscosity, the coating film 17 was scraped off immediately after 30 seconds, 60 seconds and 90 seconds had elapsed after application through spraying in the above described atmosphere, and an RR type viscometer and an RL type viscometer (trade name: VISCOMETER CONTROLLER RC-500, both made by Toki Sangyo Co., Ltd.)

were used in an airtight state, and thus, the viscosity of the coating composition was measured. The method for measurement was "spring relaxation measurement," and the viscosity of the coating composition was measured at 20° C. with a shearing rate of 0.1 (1/sec) for 60 seconds. The results are shown in Table 2. As shown in Table 2, the viscosity of the coating composition (coating film) 30 seconds after application was 76,000 mPa·s, the viscosity of the coating composition 60 seconds after application was 220,000 mPa·s and the viscosity of the coating composition 90 seconds after application was too high, making measurement using the above described viscometers impossible.

As for the above described test piece for a coating film with a pattern, a clear coating composition was applied after being left for 10 minutes so that the dry film thickness became approximately 30 μm, and the test piece was put in a drying oven after being left for 10 minutes and dried for 30 minutes at 80° C. The magnet which was pasted to the back surface of the ABS resin plate was removed before the clear coating composition was applied. As the above described clear coating composition, a mixture of 100 parts of a main agent (trade name: R240 CI, made by Nippon Bee Chemical Co., Ltd.), 16 parts of a hardening agent (trade name: R255, made by Nippon Bee Chemical Co., Ltd.) and 30 parts of a diluting solvent (trade name: Diluting Thinner for R240, made by Nippon Bee Chemical Co., Ltd.) which were stirred was used.

The thus gained coating film with a pattern was evaluated in terms of distinctness, depth appearance, appearance of movement and smoothness of the surface of the coating film on the basis of the standard shown in the following where the value of the visual judgments by 10 people, including a coating composition designer and a person in charge of design, was averaged. Furthermore, the adhesiveness of the coating film was measured in accordance with the method shown in the following. The results are shown in Table 2.

(Distinctness)

1: Border portions in the pattern were very clearly observed, 2: Border portions in the pattern were clearly observed, 3: Border portions in the pattern were somewhat obscure, 4: Border portions in the pattern were indistinctlly.

(Depth Appearance)

1: Depth was observed in the pattern and excellent depth appearance was provided, 2: Depth was observed in the pattern and good depth appearance was provided, 3: Depth was not sufficiently observed in the pattern and sufficient depth appearance was not provided, 4: No depth was observed in the pattern and depth appearance was lacking.

(Appearance of Movement)

1: When the eyes were shifted to different locations, movement was seen in the border portions in the pattern and the pattern changed significantly, 2: When the eyes were shifted to different locations, movement was sufficiently seen in the border portions in the pattern, 3: Even when the eyes were shifted to different locations, movement was not sufficiently seen in the border portions in the pattern, 4: Even when the eyes were shifted to different locations, movement was not seen in the border portions in the pattern and the pattern barely changed.

(Smoothness of the Surface of the Coating Film)

2: The front surface of the coating film was smooth and good, 4: Roughness was felt on the front surface of the coating film, which was not good.

(Adhesiveness)

The coating film was cut with a cutter on the surface so that 100 squares of 2 mm sides were prepared following ISO 4628-5, which is an international standard (JIS K5600-8-5, which is a Japanese Industrial Standard). Next, an adhesion cross-cut test where an adhesive tape was forcefully peeled after being pasted on top of the squares was conducted and judgments were made in accordance with the following standard.

2: No square was peeled, 4: One or more squares were peeled.

EXAMPLES 2 TO 10 AND COMPARATIVE EXAMPLES 1 to 6

In Examples 2 to 10 and Comparative Examples 1 to 6, tests were conducted in the same manner as in Example 1, except that the type of coating composition, the type of diluting solvent, the form of the sheet form magnet, the arrangement of the sheet form magnet and the timing of placement of the sheet form magnet were set as shown in Table 2 and Table 3. Comparative Example 1 represents an inappropriate case where the viscosity of the coating film 1 increased at too early a stage. Comparative Examples 2 and 3 represent an inappropriate case where the viscosity of the coating film 17 became much too low. Comparative Example 4 represents a case where only a sheet form magnet 12 was placed. Comparative Example 5 represents a case where only a sheet form magnet 12 was placed and the viscosity of the coating film 17 was low. Comparative Example 6 represents a case where only an N shaped sheet form magnet 12 was placed.

Where the sheet form magnet is "N shaped" in Table 2 and Table 3, the following sheet form magnets 11 and 12 were used. That is to say, the center portion of the magnet 11 in rectangular sheet form which was not magnetized was punched out in N form so that an N shaped sheet form magnet 12 was prepared, and after that, the sheet form magnets 11 and 12 were magnetized. At this time, the sheet form magnets 11 and 12 were magnetized, so that the lines of magnetic force of the sheet form magnet 11 and the lines of magnetic force of the sheet form magnet 12 extended in different directions. Next, the sheet form magnet 12 was returned to and engaged in the hole 15 resulting from separation in the sheet form magnet 11. Where the arrangement of the sheet form magnets 11 and 12 is "front" in Table 2 and Table 3, sheet form magnets 11 and 12 were placed above the coating film on the front surface of the ABS resin plate at a distance of 1 mm after application of the coating composition.

Figure 4:
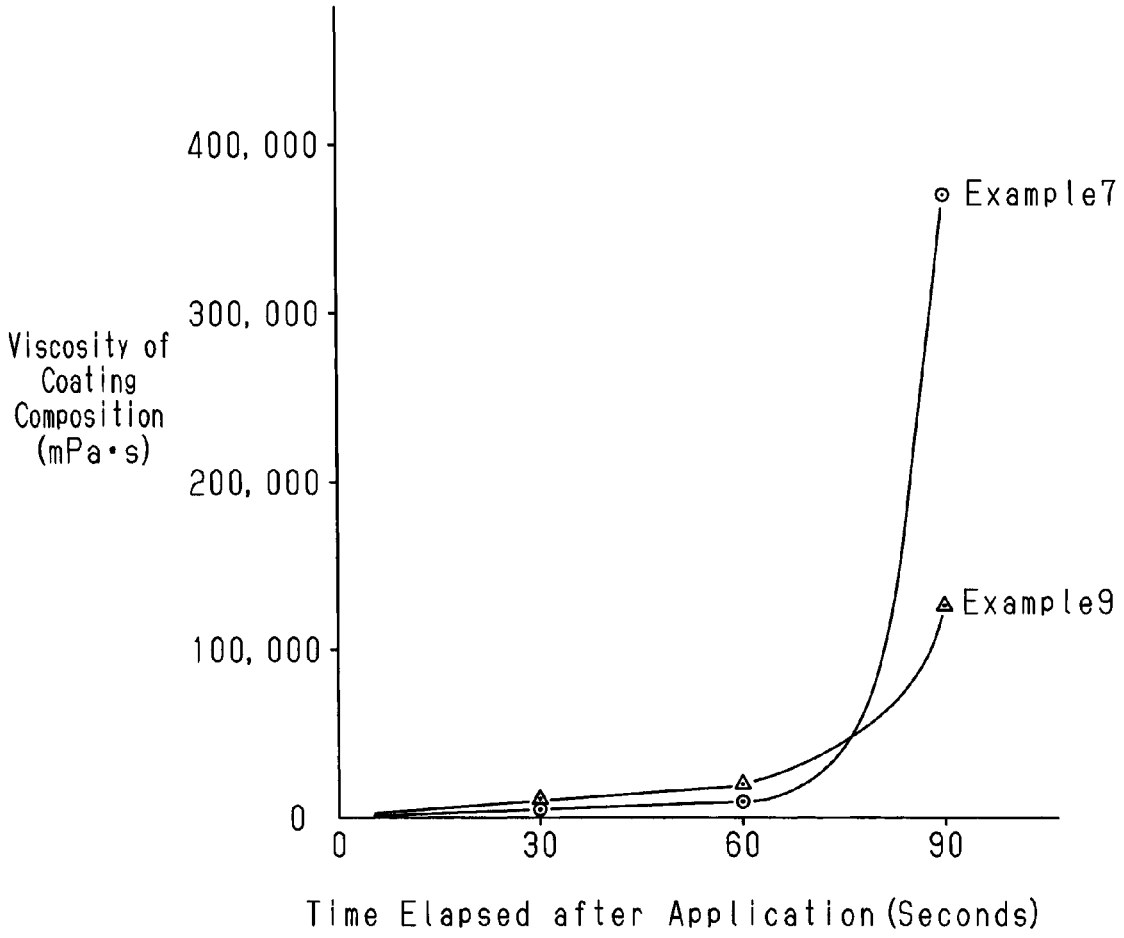
FIG. 4 is a graph showing the relationship between the time elapsed after application of a coating composition and the viscosity of the coating composition.

Then, the distinctness, depth appearance, appearance of movement, smoothness of the surface of the coating film and adhesiveness of the gained coating film 17 were measured in the same manner as in Example 1. The results are shown in Table 2 and Table 3. In addition, the relationship between the time elapsed after application of the coating composition (seconds) and the viscosity of the coating composition (mPa·s) in Example 7 is shown in FIG. 4. It is clear from this FIG. 4 that the viscosity of the coating composition was low until 60 seconds after application, and increased exponentially between 60 seconds and 90 seconds. The relationship between the time elapsed after application of the coating composition (seconds) and the viscosity of the coating composition (mPa·s) in Example 9 is also shown in FIG. 4. From the results shown, it can be seen that the viscosity of the coating composition was low until 60 seconds after application and increased exponentially between 60 seconds and 90 seconds.

TABLE 2

| | | Examples | | | | |
|---|---|---|---|---|---|---|
| | | 1 | 2 | 3 | 4 | 5 |
| viscosity (mPa · s) | 30 seconds after application | 76,000 | 76,000 | 76,000 | 76,000 | 76,000 |
| | 60 seconds after application | 220,000 | 220,000 | 220,000 | 220,000 | 220,000 |
| | 90 seconds after application | measurement impossible | measurement impossible | measurement impossible | measurement impossible | measurement impossible |
| type of coating composition | | A | A | A | A | A |
| diluting solvent | | α | α | α | α | α |
| nonvolatile content (%) | | 8.5 | 8.5 | 8.5 | 8.5 | 8.5 |
| existence of clear coating composition | | yes | yes | yes | yes | yes |
| form of magnet | | circular form | circular form | circular form | N shape | N shape |
| arrangement of magnet | | contact arrangement | contact arrangement | contact arrangement | contact arrangement | contact arrangement |
| location and timing of placement of magnet | | back, before application | back, before application | front, after application | back, before application | front, after application |
| distinctness | | 1 | 1 | 1 | 1 | 1 |
| depth appearance | | 1 | 1 | 1 | 1 | 1 |
| appearance of movement | | 1 | 1 | 1 | 1 | 1 |
| smoothness of the surface of the coating film | | 2 | 2 | 2 | 2 | 2 |
| adhesiveness | | 2 | 2 | 2 | 2 | 2 |

| | | Examples | | | | |
|---|---|---|---|---|---|---|
| | | 6 | 7 | 8 | 9 | 10 |
| viscosity (mPa · s) | 30 seconds after application | 76,000 | 4,870 | 104,000 | 10,000 | 70,000 |
| | 60 seconds after application | 220,000 | 10,000 | 3,010,000 | 20,000 | 150,000 |
| | 90 seconds after application | measurement impossible | 368,000 | measurement impossible | 123,000 | measurement impossible |
| type of coating composition | | A | A | A | B | C |
| diluting solvent | | α | β | γ | α | α |
| nonvolatile content (%) | | 12.0 | 8.5 | 8.5 | 8.5 | 8.5 |
| existence of clear coating composition | | yes | yes | yes | yes | yes |
| form of magnet | | circular form | circular form | circular form | circular form | circular form |
| arrangement of magnet | | contact arrangement | contact arrangement | contact arrangement | contact arrangement | contact arrangement |
| location and timing of placement of magnet | | front, after application | front, after application | front, after application | front, after application | front, after application |
| distinctness | | 1 | 1 | 1 | 2 | 2 |
| depth appearance | | 1 | 1 | 1 | 2 | 2 |
| appearance of movement | | 1 | 1 | 1 | 2 | 2 |
| smoothness of the surface of the coating film | | 2 | 2 | 2 | 2 | 2 |
| adhesiveness | | 2 | 2 | 2 | 2 | 2 |

TABLE 3

| | | Comparative Examples | | | | | |
|---|---|---|---|---|---|---|---|
| | | 1 | 2 | 3 | 4 | 5 | 6 |
| viscosity (mPa · s) | 30 seconds after application | 40,000 | 610 | 2100 | 76,000 | 2100 | 76,000 |
| | 60 seconds after application | measurement impossible | 900 | 5000 | 220,000 | 5000 | 220,000 |

TABLE 3-continued

| | Comparative Examples | | | | | |
|---|---|---|---|---|---|---|
| | 1 | 2 | 3 | 4 | 5 | 6 |
| 90 seconds after application | measurement impossible | 1090 | 50,000 | measurement impossible | 50,000 | measurement impossible |
| type of coating composition | A | A | B | A | B | A |
| diluting solvent | α | α | β | α | β | α |
| nonvolatile content (%) | 16.0 | 3.5 | 8.5 | 8.5 | 8.5 | 8.5 |
| existence of clear coating composition | yes | yes | yes | yes | yes | yes |
| form of magnet | circular form | circular form | circular form | circular form | circular form | N shape |
| arrangement of magnet | contact arrangement | contact arrangement | contact arrangement | single arrangement | single arrangement | single arrangement |
| location and timing of placement of magnet | front, after application | front, after application | front, after application | front, after application | front, after application | front, after application |
| distinctness | 3 | 3 | 3 | 3 | 4 | 3 |
| depth appearance | 2 | 3 | 3 | 2 | 4 | 2 |
| appearance of movement | 2 | 3 | 3 | 2 | 4 | 2 |
| smoothness of the surface of the coating film | 4 | 4 | 2 | 2 | 2 | 2 |
| adhesiveness | 2 | 2 | 2 | 2 | 2 | 2 |

As shown in Table 2 and Table 3, distinctness, depth appearance, and the appearance of movement were all excellent in Examples 1 to 8. This is considered to be because the sheet form magnets 11 and 12 were placed in such a state as to contact each other, the extreme value of the lines of magnetic force 18 was above the contact portions 19 between the sheet form magnets 11 and 12, the magnetic particles 23 in the coating film 17 in these locations were oriented substantially parallel to the coating film surface, and light reflected from the magnetic particles 23 in the contact portions 19 between the sheet form magnets 11 and 12 was oriented in the same direction. In Examples 9 and 10, though distinctness, depth appearance, and the appearance of movement were slightly lower than in Examples 1 to 8, due to the difference in the type of coating composition and the change in the viscosity of the coating composition after application, a sufficient decorative feel was gained.

In Comparative Example 1, where the viscosity of the coating film 17 was extremely high, the distinctness of the pattern 21 was insufficient, and the smoothness on the front surface of the coating film was poor. In Comparative Examples 2 and 3, where the viscosity of the coating film 17 was low, the distinctness, depth appearance, and appearance of movement of the pattern 21 were all insufficient. In Comparative Example 4, where only a sheet form magnet 12 was arranged, the distinctness was poor in comparison with Example 3, and the depth appearance, and appearance of movement were also poor. In Comparative Example 5, where only a sheet form magnet 12 was arranged and the viscosity of the coating film 17 was low, the distinctness, depth appearance, and appearance of movement of the pattern 21 were all poor. In Comparative Example 6, where only an N shaped sheet form magnet 12 was arranged, the distinctness was poor in comparison with Example 5, and the depth appearance, and appearance of movement were also poor. Accordingly, it is clear that the conditions both in terms of the arrangement where sheet form magnets 11 and 12 contact each other and the appropriateness of the change in the viscosity of the coating composition should be satisfied.

The invention claimed is:

1. A pattern forming method for forming a pattern on a coating film on an article, the method comprising:

preparing a coating composition containing magnetic particles with flaky form;

applying said coating composition to the article to be coated and form the coating film on the article;

arranging a plurality of sheet form magnets along the surface of said coating film with the magnets adjacent to each other, wherein each sheet form magnet has a side surface, a front surface, and a back surface, the front and back surfaces having magnetic poles, and wherein the sheet form magnets are arranged with the magnetic poles of adjacent sheet form magnets different between the front surface and the back surface of the sheet form magnets, and side surfaces of the sheet form magnets contact each other, and thus, the plurality of sheet form magnets are provided with contact portions of respective sheet form magnets; and forming a pattern on the coating film by applying a magnetic field to the coating film using said plurality of sheet form magnets so that magnetic particles in the coating film are oriented by the magnetic field, wherein magnetic particles are oriented substantially parallel to the front surface of the coating film above the contact portions of said respective sheet form magnets and substantially perpendicular to the front surface of the coating film above the non-contact portions of said respective sheet form magnets, and a pattern is formed on the coating film at least by the magnetic particles above the contact portions of the respective sheet form magnets, wherein said coating composition further contains a thermoplastic resin, a low boiling point solvent having a boiling point of 50° C. or higher and 100° C. or lower, and a high boiling point solvent having a boiling point of higher than 100° C. and 200° C. or lower, wherein said coating composition has a viscosity, between 20 seconds to 60 seconds after application of the coating composition to the article, that is 2,000 mPa·s to 500,000 mPa·s under normal conditions, the viscosity of the coating composition between 60 seconds and 120 seconds after application is 100,000 mPa·s or higher, and the viscosity of the coating composition between 60 seconds to 120 seconds after application is greater than the viscosity of the coating composition 20 seconds to 60 seconds after application.

2. The method according to claim 1, wherein said magnetic field is closed between the magnetic poles of the respective sheet form magnets in the vicinity of the contact portions between said respective sheet form magnets, and the pattern is formed by the magnetic particles which are oriented by the closed magnetic field.

3. The method according to claim 1, wherein said plurality of sheet form magnets have lines of magnetic force which are closed between the magnetic poles of adjacent sheet form magnets, and wherein the lines of magnetic force have an extreme value which is located above a contact portion between said respective sheet form magnets.

4. The method according to claim 1, wherein said thermoplastic resin is a vinyl acetate based resin, an acryl based resin, or a cellulose acetate butyrate resin.

5. The method according to claim 1, wherein said coating composition has a nonvolatile content of 5 mass % to 15 mass %.

6. The method according to claim 1, wherein said coating composition contains a dye as a coloring agent.

7. The method according to claim 1, wherein said article is in sheet form.

8. The method according to claim 1, wherein the front surface of said coating film is flat.

9. The method according to claim 1, wherein said high boiling point solvent contains a high boiling point first solvent having a boiling point of higher than 100° C. and 150° C. or lower, and a second high boiling point solvent having a boiling point of higher than 150° C. and 200° C. or lower.

* * * * *